US007997102B2

(12) United States Patent
Obadalova

(10) Patent No.: US 7,997,102 B2
(45) Date of Patent: Aug. 16, 2011

(54) KNITTED PRODUCT

(75) Inventor: Marta Obadalova, Brno (CZ)

(73) Assignee: Golden Lady Company S.p.A.

( * ) Notice: Subject to any disclaimer, the term of this patent is extended or adjusted under 35 U.S.C. 154(b) by 355 days.

(21) Appl. No.: 11/919,531

(22) PCT Filed: May 2, 2006

(86) PCT No.: PCT/CZ2006/000028
§ 371 (c)(1),
(2), (4) Date: Oct. 29, 2007

(87) PCT Pub. No.: WO2006/119715
PCT Pub. Date: Nov. 16, 2006

(65) Prior Publication Data

US 2009/0229311 A1 Sep. 17, 2009

(30) Foreign Application Priority Data

May 9, 2005 (CZ) ..... 2005-293

(51) Int. Cl.
*D04B 7/00* (2006.01)

(52) U.S. Cl. ..... 66/177

(58) Field of Classification Search ..... 66/170, 66/171, 177, 178 R, 179
See application file for complete search history.

(56) References Cited

U.S. PATENT DOCUMENTS

| | | | | | |
|---|---|---|---|---|---|
| 701,744 | A * | 6/1902 | Love | 2/408 |
| 3,344,621 | A * | 10/1967 | Gilchrist | 66/175 |
| 3,487,662 | A * | 1/1970 | Safrit et al. | 66/173 |
| 3,566,624 | A * | 3/1971 | Burleson | 66/177 |
| 3,595,034 | A * | 7/1971 | Safrit | 66/27 |
| 3,694,816 | A * | 10/1972 | Smith | 2/409 |
| 3,808,842 | A * | 5/1974 | Fisher et al. | 66/177 |
| 3,852,827 | A * | 12/1974 | Colbert, Jr. | 2/409 |
| 3,975,924 | A * | 8/1976 | Furia | 66/14 |
| 4,043,156 | A * | 8/1977 | Pernick | 66/177 |
| 5,163,306 | A * | 11/1992 | Boehm et al. | 66/177 |
| 5,709,107 | A * | 1/1998 | Jeffcoat | 66/179 |
| 6,119,491 | A * | 9/2000 | Pinelli | 66/177 |
| 6,196,030 | B1 * | 3/2001 | Stoll et al. | 66/178 R |
| 7,024,892 | B2 * | 4/2006 | Blakely | 66/177 |
| 2004/0065123 | A1 * | 4/2004 | Okamoto | 66/49 |

FOREIGN PATENT DOCUMENTS

| | | | |
|---|---|---|---|
| GB | 1243506 | A * | 8/1971 |
| JP | 47-5227 | | 2/1946 |
| JP | 47-005227 | | 9/1972 |
| JP | 09-143802 | | 6/1997 |
| JP | 2001-200401 | | 7/2001 |
| JP | 2002-088504 | | 3/2002 |
| JP | 2005-015925 | | 1/2005 |

* cited by examiner

*Primary Examiner* — Danny Worrell

(74) *Attorney, Agent, or Firm* — McGlew and Tuttle, P.C.

(57) ABSTRACT

Knitted products like slips, panties, trousers and mainly tights are closed in the crotch area (K) with at least a pair of opposed knitted-on elements (1A, 1B, 2A, 3A) passing to the crotch (K).

The product can be knitted from the border of the body part via at least a pair of knitted-on elements and up to the knitting of the parts for the legs or you can knit from the parts for legs via at least a pair of knitted-on parts and it is finished with a border in the body part.

21 Claims, 8 Drawing Sheets

KNITTED PRODUCT

TECHNICAL FIELD

The invention concerns knitted products like trousers, slips, panties, mainly tights.

BACKGROUND ART

According to the know state of the art, knitted products of relevant type—in concrete terms the tights—are manufactured in such a way that the two legs are knitted separately and these are consequently straight-cut in their upper part and then they are sewn together and so the body part is created. This technology of manufacture is well developed and very sophisticated machines—usually automatic or semi-automatic textile machines—were developed for the technology performance. The main disadvantage of tights manufactured in this way is the fact that at point of inter-connection of the two legs and the tight part, the three hoses are practically connected in one point, which is extremely loaded during wearing and seam damage often occurs. Another important disadvantage is also the fact that the seam in the panties section—mainly in case of ladies tights—is significantly unaesthetic.

So as to eliminate the main disadvantage of classic manufacture of tights, there was developed the technology of gore sewing in the point of connection of legs and the body. By sewing in the gore, there was practically fully eliminated the main disadvantage. But this is a technology that has not been automated to acceptable level yet, so it brings undesirable manual operations to the production cycle, delaying the manufacturing process. The question of poor aesthetics of the seam also remained unsolved.

In the course of time, there were developed the small-diameter knitting machines, adjusted to manufacture of tights from one piece, without necessity of sewing the panty section together. There exist several categories of the knitting machines and consequently even products.

As a basic category of these products it is possible to consider tights—their manufacture in knitting industry jargon is called "knitting from toe to toe". In case of this group of products, manufacture has been started by knitting the toe of one of the legs, it continued by knitting the body part with simultaneous creation of the waist hole and it was finished by knitting the other leg. There also known the solutions when the body part was knitted by reverse run with the purpose of obtaining bigger panties section. But this category of products showed one significant disadvantage that was not successfully eliminated and that was a cause for the products to gradually leave the markets. While in case of classic tights, the knitted fabric lines of the body section are parallel to the leg section, the number of columns of the knitted fabric in the body is twice the number of columns in the leg section. The height of the panties is practically unlimited, while in case of products in the category "knitting from toe to toe" the lines of the knitted fabric in the body section are practically perpendicular to the lines of the knitted fabric of the leg. The number of columns of the knitted fabric—that is in this case decisive for the height of the panties—is even lower than the number of columns in the leg and that causes insufficient height of the body section. That is the main cause why this category of products has not found its permanent position in the market.

Tights manufactured on small-diameter knitting machines equipped with two needle-rolls represented another category of the products. One product of this category was manufactured in such a way that knitting started by knitting the upper section by applying the reverse run simultaneously on both of the needle-rolls. After knitting the body part, there were simultaneously knitted both of the legs by rotation run, while the leg knitted on the upper roll was drafted in to the hollow of the leg knitted in the bottom needle-roll. The main disadvantages of the tights were the facts that the point of connection of both of the legs with the body part was strongly prone to the knitted fabric ripping, while the proper concept of the knitting machine did not allow required fineness of the knitted fabric to be reached, it did not allow development of patterns with exuviated face thread and strengthened patterns. There is also known a variant solution, when the body part was knitted by rotation run of the needle-rolls, while on a part of the circumference of both of the needle-rolls, the hoses were knitted together and then cut up. But the quality of such a seam was poor and it did not find any possible application in the course of time.

There is also known the category of products manufactured on single-roll knitting machines, using special exuviation jacks, respectively using a device plate. In case of this category of products there was usually knitted one of the legs at first, then approximately half of the needle-roll circumference was transferred to jacks to non-operation position and then knitting of the second leg followed. After finishing the second leg knitting, there were dropped down the links from that part of the circumference, where there were placed the links of the first leg transferred to jacks. Then, the knitting of the body part followed, using full number of knitting needles as used for knitting of both of the legs. There is also known a technical solution when—while using the device plate—there was closed the space created by putting off the knitted fabric from a part of the circumference. The main disadvantages of this category of products include insufficient number of columns of the knitted fabric in the body part of the product and mainly low aesthetic value of the products.

Seamless textile product—for example tights—could be theoretically as well as practically manufactured on popular double-bedded knitting machines. But the machines were not applied in practical manufacture mainly due to low productivity of flat knitting machines compared to small-diameter knitting machines and poor quality of product performance in case of tights.

Textile of the underwear type like boxers, panties, slips and so on are practically manufactured in two ways. The first—in fact classic—way includes manufacture of a semi-product for example on large-diameter knitting machines, cutting the semi-product to relevant shape and consequent sewing of the final product. But the classic way of manufacture has some disadvantages, including high share of manual work with small level of automation as well as the fact that the seams—mainly in the buttock area—have significantly different volume and elasticity than the remaining part of the product and they are visible under the outwear, which is frequently undesirable. The efforts aimed at reaching increased elasticity of underwear caused introduction of production technology, when the semi-product is manufactured on medium-diameter knitting machine. Then, the semi-product is cut off the main knitted fabric and the edges are sewn. But even the underwear manufactured in this way shows the above-specified disadvantageous features and more, it causes quite significant technologic waste of the expensive input material.

DISCLOSURE OF THE INVENTION

That is why it is the aim of the invention to create such a seamless knitted product of underwear type and to find the relevant method of its manufacture so as to maximally eliminate the faults of the current technical solution.

Then, it is the aim for the product to be knitted on flat double-bedded knitting machines as well as on double-roll knitting machines. This can be significantly reached by seamless knitted products according to this invention that is based mainly on the fact that the crotch area is closed by at least one pair of knitted-on elements that are placed opposite to each other.

The main advantage of seamless knitted products according to the invention is the fact that the three hoses are not inter-connected in one point, but along the circumference of the area consisting of knitted-on parts, being an integral part of both legs and the body part. That means that there can be reached anatomic shape of the product with simultaneous arrangement of equal and balanced tension of the knitted fabric, which means that it is not breached at the inter-connection spot. Other advantages include the fact that it is very easy to use a mix of materials with different characteristics for manufacture of individual parts of the product—for example massive cotton in the knitted-on part, fine cotton in combination with elastomere for the body part and synthetic material for the legs. The product manufactured in compliance with the invention does not cause well-known and undesirable deformation of buttocks, as it is seamless. That means that it is practically invisible under the outwear. Other advantages of the product according to the invention include easy making on a sole type of textile machine, for example on a special double-roll small-diameter knitting machine with the possibility of high level of production automation, practically negligible technologic waste, high aesthetic value and relatively low production costs.

For simple knitting of products like slips it seems favourable when the pair of knitted-on elements is on opposite sides of the body part, with their tops oriented one against the other.

If it is desirable for the legs to be more apart from each other at the crotch section, it is purposeful for the pair of knitted-on parts to be placed in mirror layout on enclosed parts of the leg circumferences.

From the point of view of knitted product shape performance in the crotch it is favourable for the knitted-on parts to narrow in the direction of their tops.

It is favourable if the border lines of the knitted-on part in the body part are connected with the adjacent border lines of the knitted-on parts for legs, as it eliminates sewing of the body part together with the legs and simultaneously the deformation of the product with seams. That improves the product appearance for wear.

In case of a requirement for enlarged surface of the knitted-on part and higher covering ability it is favourable for at least one of the knitted-on parts of the body part to continue the additional knitted-on part to the body part.

So as to improve the comfort of wear it is favourable—mainly in case of tights—for the knitted-on parts to be made of different material than the body part and legs.

From the point of view of the product aesthetic level it is favourable for the knitted product to be patterned.

Then, from the production point of view it is favourable for the tights when the legs follow the shape of stockings with closed toes, as there are eliminated all and any other finishing operations.

The base of the simple way of knitted products manufacture according to the invention states that the knitting starts from the body part border, it continues by knitting at least one pair of knitted-on parts and consequent knitting of legs. This is favourable even thanks to the fact that it is possible to reach high-quality double border with non-unsewable beginning.

But for knitting of tights it is favourable to knit the legs at first and then there is knitted at least one pair of knitted-on parts and the knitting process is finished by the border in the body part, as in such a case it is possible to close the toes directly on the machine.

For knitting on flat double-bedded knitting machine it is favourable for the body part, the legs as well as the knitted-on parts to be knitted by reverse run while using the double-bedded flat knitting machine.

The favourable method of knitted product manufacture according to the invention on double-bedded knitting machine is based on the fact that the legs are knitted by rotation run of both of the needle rolls, at least the pair of opposite knitted-on parts is knitted by reverse run of both of the needle rolls and the knitting procedure based on reverse run of needle rolls for the body part.

Taking into consideration the unsewing of the product, it is favourable that the knitted-on part in the body part is gradually connected by its border lines with the adjacent border lines of the pair of knitted-on parts of the legs.

One of the advantages of the seamless knitted products according to the invention is characterised by the fact that it can be produced on the basis of manual knitting or on double-bedded flat knitting machine as well as on double-roll small-diameter knitting machine.

If the seamless knitted product according to the invention is to be manufactured on a double-roll small-diameter knitting machine, it will be favourable mainly thanks to the fact that the legs may be knitted by classic rotation run of both of the needle rolls without any minor traces of longitudinal stripes. The production costs are fully comparable with the classic production technology and simultaneously, the seamless knitted product according to this invention shows new and better characteristics compared to well-known products manufactured in compliance with hitherto known technical status.

BRIEF DESCRIPTION OF DRAWINGS

The invention will be explained in detail while using the drawings, schematically showing—in FIG. 1—the view of the knitted product in sample version as ladies' or children tights, in FIG. 2 the knitted product in the form of panties, in FIG. 3 the knitted product in the form of slips, in FIG. 4 the trousers with additional knitted-on part, in FIG. 5 closing of the crotch with knitted-on parts, in FIG. 6 the detail of knitting connection of the knitted-on parts, being an integral part of both of the legs, in FIG. 7 the detail of the knitting connection of gores, being an integral part of the panties part, in FIG. 8 the detail of knitting connection in the crotch area of the knitted product established on the basis of mutual connection of the two knitted-on parts being an integral part of both legs with two knitted-on parts being an integral part of the panties part, in FIG. 9 the knitted product in decomposed status in case of knitting on double-bedded knitting machine, in FIG. 10, 11 and 12 the steps of manufacture of a knitted product on double-roll knitting machine.

DESCRIPTION OF PREFERRED EMBODIMENT

In the present application, the term Knitted panty hose garment is to be understood as including slips, trousers and tights.

Figure 1:
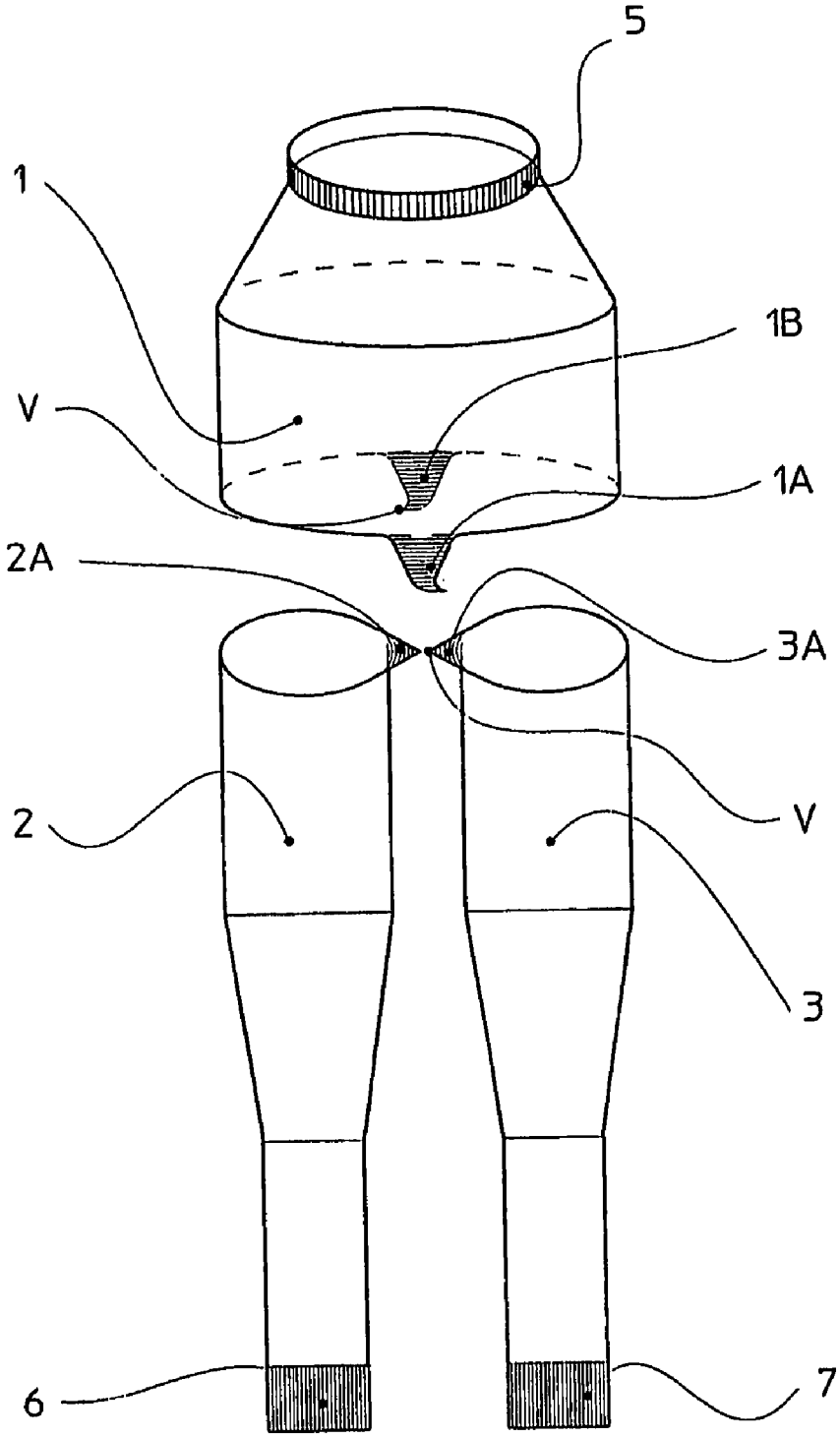
Figure 5:
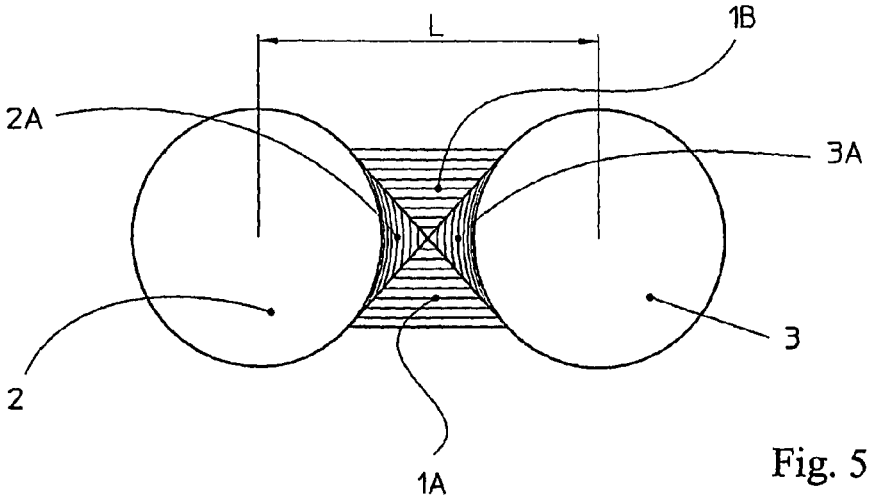

Knitted product in sample version according to FIG. 1—the panties type—includes the body part 1 finished with a flexible border 5 and a pair of parts 2, 3 for legs finished with toes 6, 7, favourably closed directly on the machine, without additional sewing. In the crotch section K, the body part 1 and the legs 2, 3 are interconnected in this version by four knitted-on parts 1A, 1B, 2A, 3A, that close the crotch area K in this way, see FIG. 5. In this case, the knitted-on parts 1A, 1B are two and they make an integral part of the body part 1 and they extend it. The knitted-on parts 1A, 1B are located on opposite halves of the circumference of the body part 1 in such a way that one knitted-on part 1A is located in the front of the body part 1 and the other one in the rear part of the body part 1. In this case, the knitted-on parts 1A, 1B are wedge shaped and they can be—as specified below—even of some other shape, but they are always shaped in such a way so as they become narrower in the direction of the V top. The legs 2, 3 also contain a pair of knitted-on parts 2A, 3A—one part on each of the legs 2, 3, while they are placed on adjacent parts of circumferences in mirror position and—in relation to the position of knitted-on parts 1A, 1B—they are partially turned in 90°. The shape of knitted-on parts 2A, 3A is similar to the shape of knitted-on parts 1A, 1B i.e. they become narrower in the direction of the V top, but they do not have to be symmetrical, which means that their part adjacent to the knitted-on part 1A may differ from the part adjacent to the knitted-on part 1B.

The knitted-on parts 1A, 1B, 2A, 3A close the crotch area K by being interconnected on their edge, while they simultaneously increase the distance L in the crotch areas K between the legs 2, 3 compared to the distance without knitted-on parts 1A, 1B, 2A, 3A. The increase of the distance L between the legs 2, 3 can be affected mainly by knitted-on parts 2A, 3A.

As it was stressed out in the previous section of the file, the invention may be advantageously applied to the group of knitted products that is collectively called underwear, consisting of body part 1 and possibly also legs 2, 3. The basic description will be performed on one of the group of products—the tights.

Figure 6:
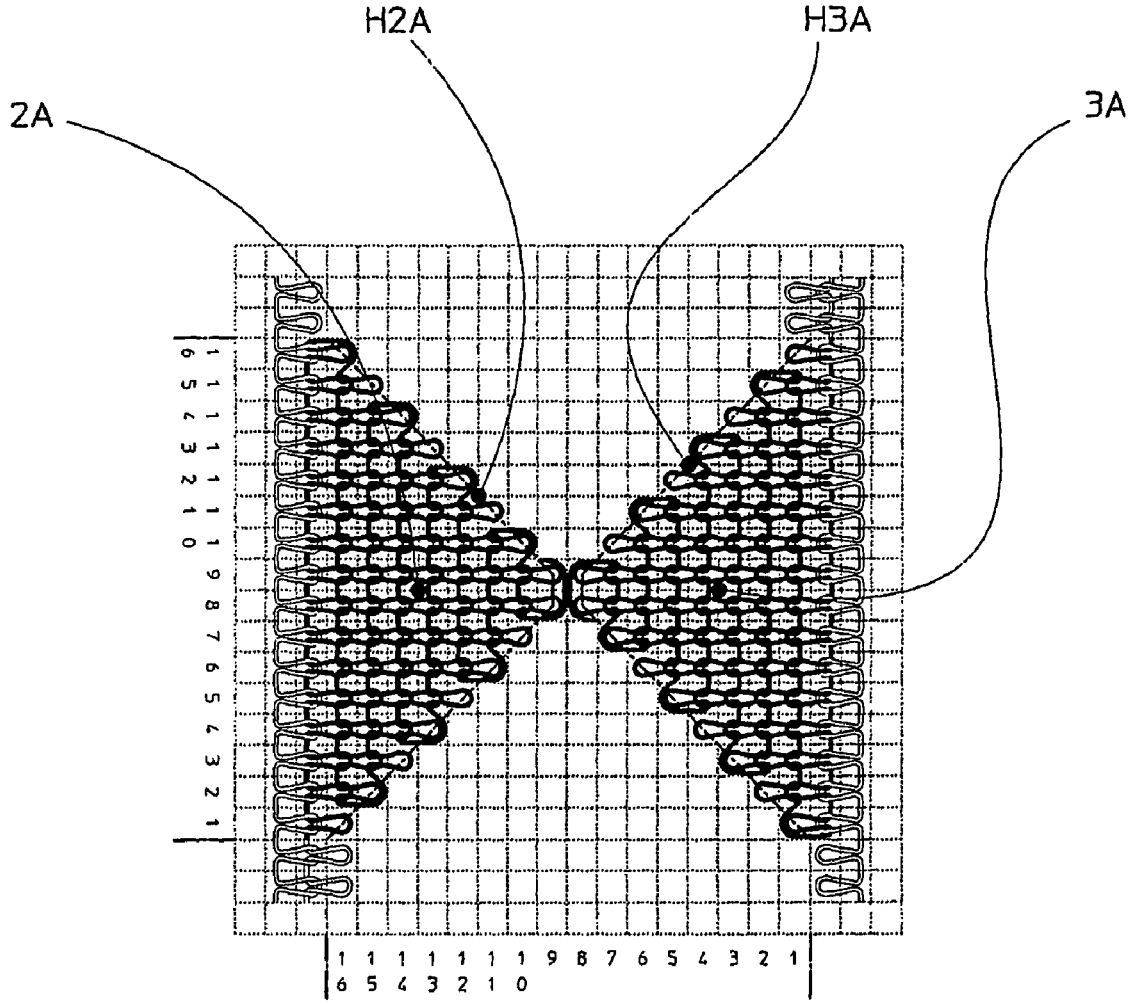

FIG. 6 shows a sample version of knitting connection of the knitted-on parts 2A, 3A to the legs 2, 3, that are made of smooth structure with decrease of the number of lines O. The shape of knitted-on parts 2A, 3A during machine production is in fact limited only by the characteristics of the pattern-setting mechanism of the textile machine, which means that the border lines H2A, H3A may be placed on the straight line as in the sample, but also on any curve. The shape of knitted-on parts 2A, 3A does not have to by symmetrical in all the cases and it depends only on concrete requirements regarding the given product.

Figure 7:
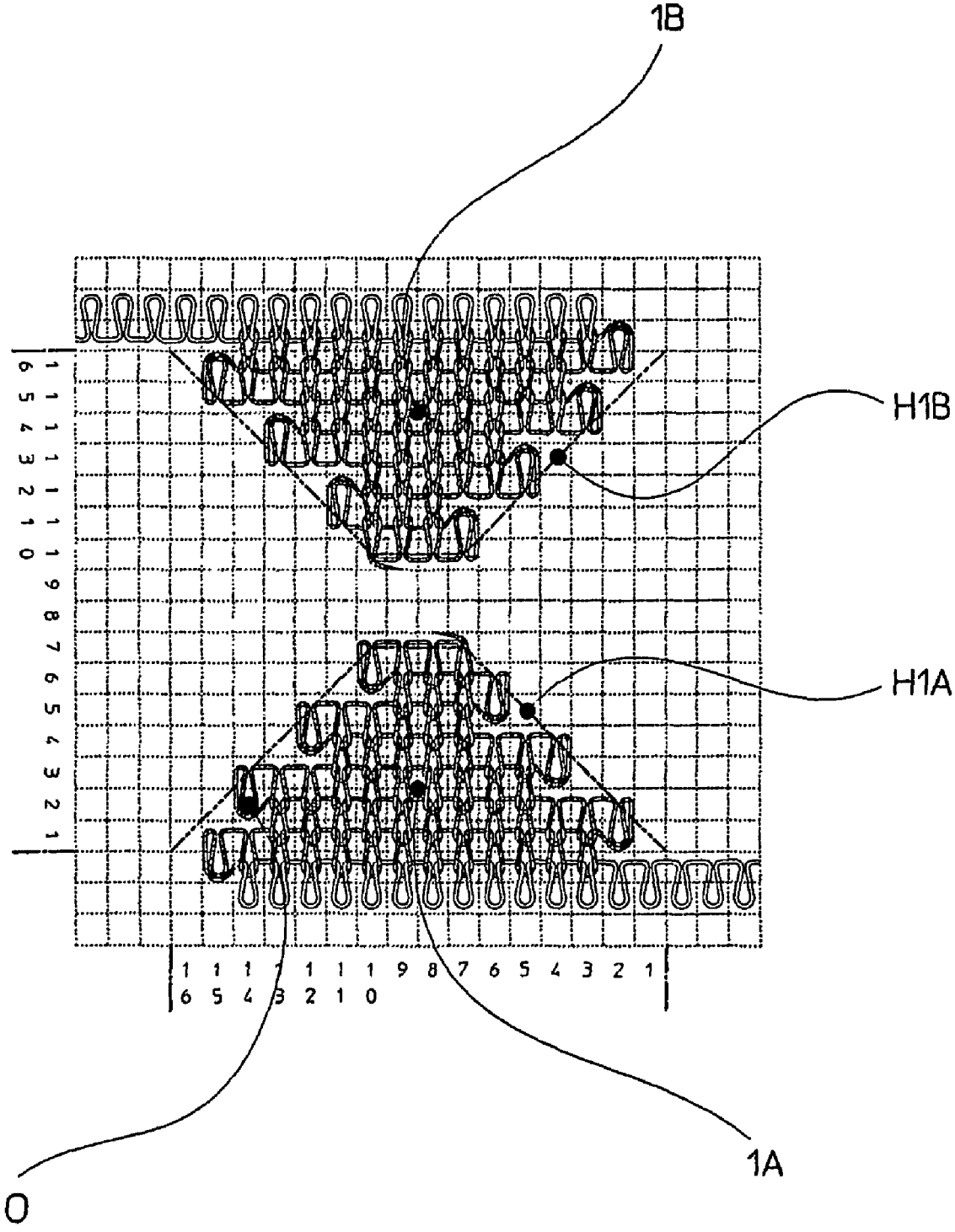

The sample version of the knitting connection of knitted-on parts 1A, 1B of the body part 1 is shown in FIG. 7 again from smooth structure with elimination of lines O in such a way, that there is created in fact a knitted-on part in the gore shape. As far as it concerns the border lines H1A, H1B and the shape of knitted-on parts 1A, 1B, it is possible to say the same as in case of knitted-on parts 2A, 3A of legs 2, 3. The knitting structure of mutual connection of the sample version of knitted-on parts 1A, 1B, 2A, 3A according to the invention is shown in detail in FIG. 8, mainly showing that the connection can not be unsewn without any seam.

Figure 2:
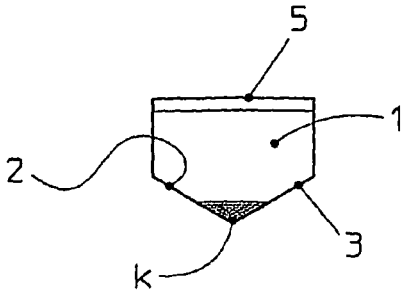
Figure 3:
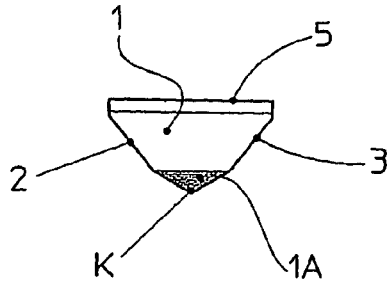
Figure 4:
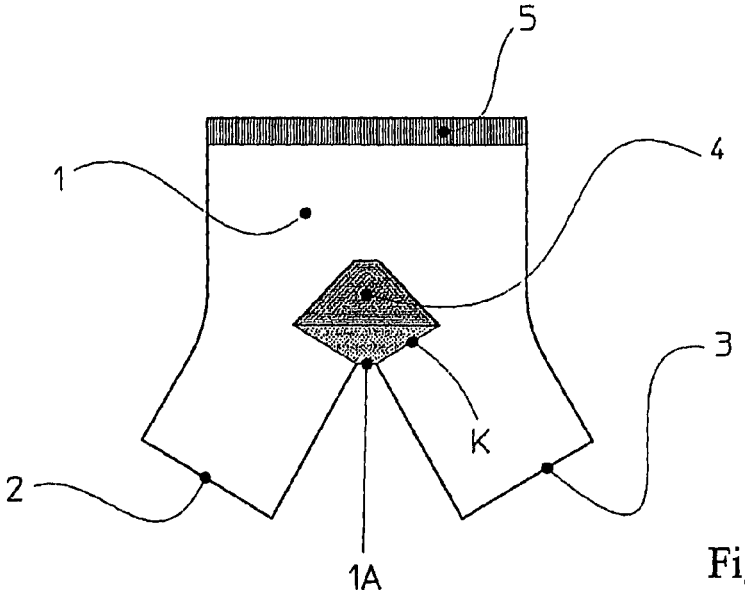
Figure 8:
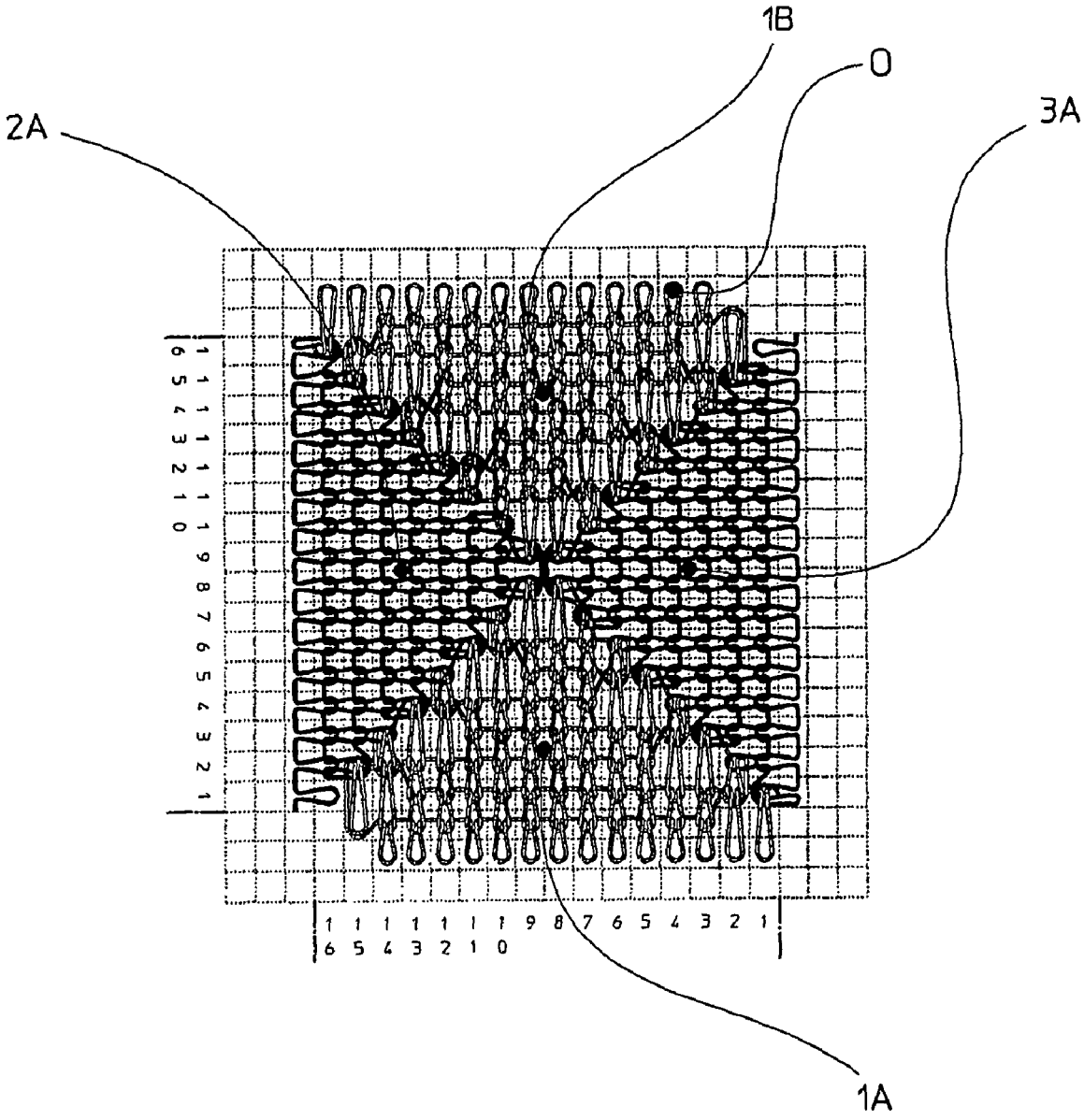

As it is clearly schematically shown in FIG. 2, 3, 4, the invention can be easily applicable even to other types of products, not only the tights. In such a case, the number of lines in legs 2, 3 will be limited to necessary minimum to knit the needles into the unsewable beginning. It can be also favourably applied to classic panties, respectively various shaped slips. If there is required an increased area of the knitted-on parts 1A, 1B, 2A, 3A, it is possible to complete the above-described knitted-on parts 1A, 1B, 2A, 3A with an additional knitted-on part 4, mainly in the front part of the product, above the knitted-on part 1A in such a way, as shown in FIG. 8. The number of knitted-on parts 1A, 1B, 2A, 3A for simpler manufacture—for example slips—may be limited to two knitted-on parts 1A, 1B in the body part 1 or three knitted-on parts 1A, 2A, 3A using an additional knitted-on part 4 and so on.

One of great advantages of knitted seamless product according to the invention is the fact that it may be manufactured by using different knitting techniques, for example by manual knitting, knitting on double-bedded knitting machine, respectively by knitting on a special double-roll small-diameter knitting machine.

Figure 9:
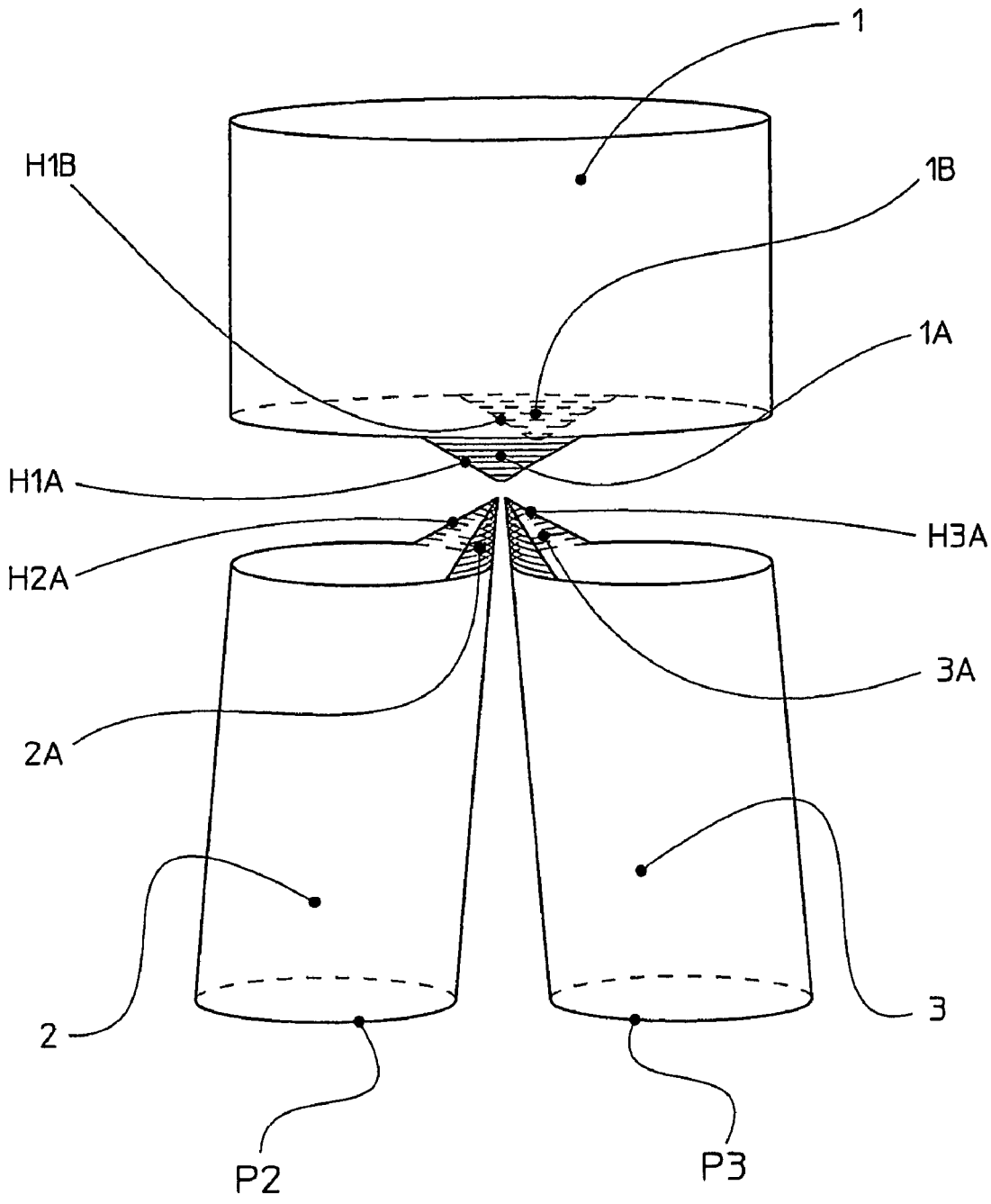

The procedure of knitted product manufacture according to the invention and using the double-bedded knitting machine, may be explained on the basis of FIG. 9. The product knitting starts for example by the initial line P2 of the leg 2. Knitting of the leg 2 is finished by knitting the knit-on part 2A, while a half of it is knitted on knitting needles of the front bed and the other half of the knit-on part 2A is knit on knitting needles of the rear bed. After knitting the leg 3 including the knit-on part 2A, the knitting of the product will continue by knitting leg 3 including the knit-on part 3A, while the leg 3 and the knit-on part 3A are in fact a mirror display of the leg 2 with the knit-on part 2A. After knitting both of the legs 2, 3 including knit-on parts 2A, 3A knitting continues for example by knitting the knit-on part 1A of the body part 1 using the knitting needles of the front bed, the border lines H1A of the knit-on part 1A will be gradually connected with the part of the border lines H2A of the knit-on part 2A and border lines H3A of the knit-on part 3A, that were knitted on knitting needles of the front bed, while in this case, the border lines H1B of the knit-on part 1B will be gradually connected with the part of the border lines H2A of the knit-on part 2A and border lines H3A of the knit-on part 3A, that were knitted by using the knitting needles of the rear needle bed. After knitting both of the knit-on parts 1A and 1B of the body part 1 and connection of border lines H1A and H1B with border lines H2A and H3A the body part 1 is to be knitted.

Figure 10:
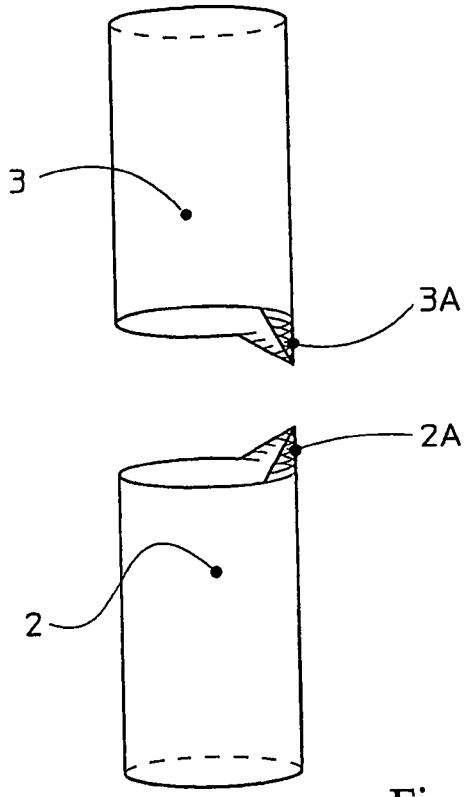
Figure 11:
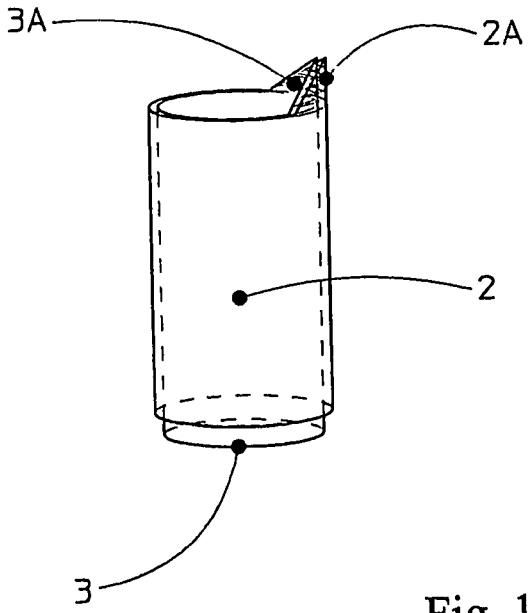
Figure 12:
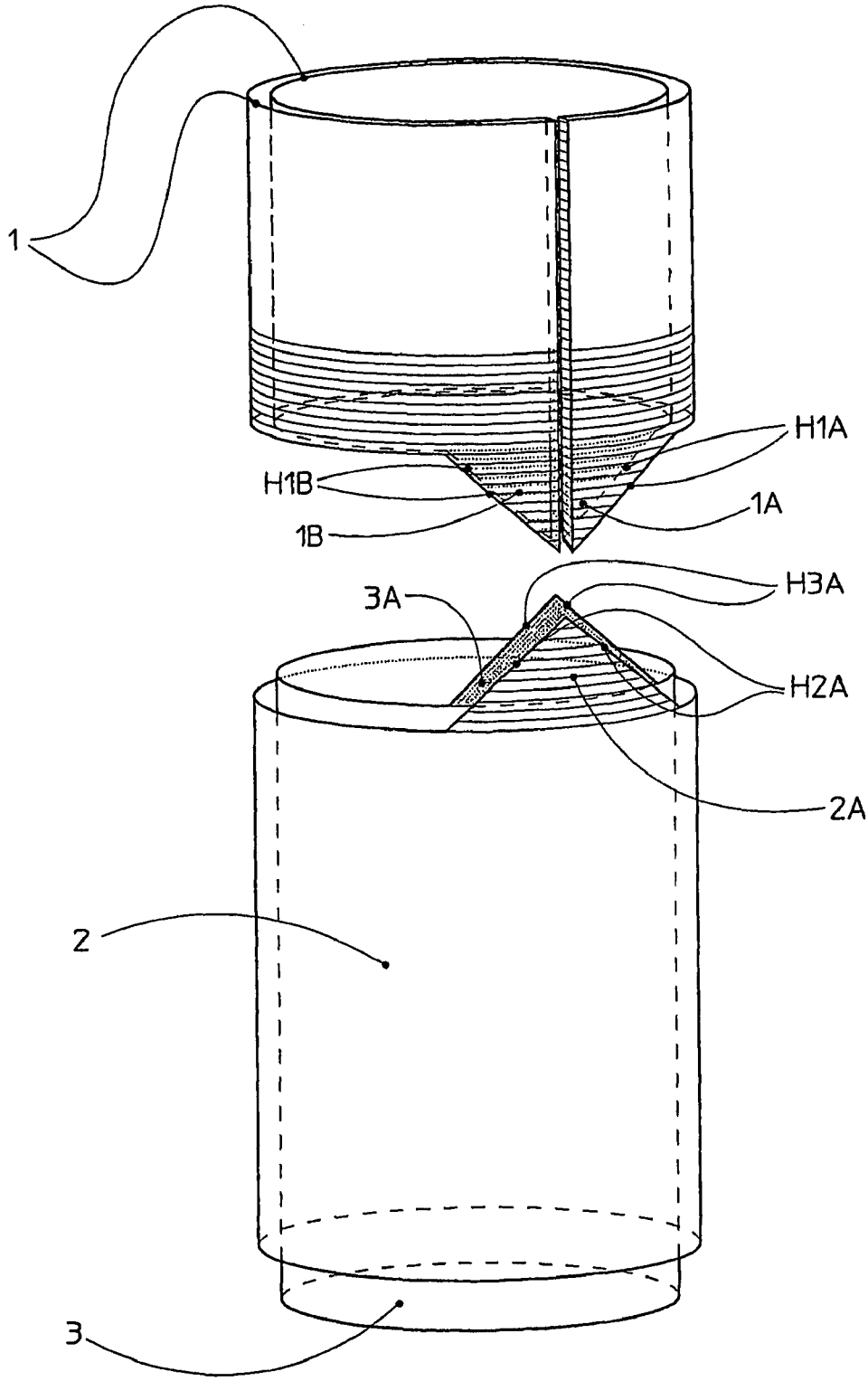

The procedure of manufacture of the seamless knitted product according to the invention, using the double-roll small-diameter knitting machine is shown in its individual stages in FIG. 10, 11 and 12. In this case, there starts simultaneous knitting of legs 2, 3 from toes, by using rotation run of both of the needle rolls. After knitting the whole length of the legs 2, 3, the machine starts simultaneous knitting of both of the knit-on parts 2A, 3A by using reverse run of the needle rolls, similarly as in case of knitting the first gore of the heel in case of classic stockings. After finishing the knitting of knit-on parts 2A, 3A, the leg 3 is moved to the hollow of the leg 2, but it remains on the knitting needles of the upper roll. The resulting mutual position of the legs 2, 3 is shown in FIG. 11. Then, there starts knitting of the knit-on part 1B of the body part I by applying reverse run of the needle rolls, while one half of the knit-on part 1B is knitted on the bottom needle roll and the other half of the knit-on part 1B is knitted on the upper needle roll. Simultaneously, there are automatically knitted together the border lines H1B of the knit-on part 1B with relevant border lines H2A, H3A of the knit-on parts 2A, 3A. Both created parts of knitted fabric are exhausted by air to the lower needle roll. FIG. 12 shows the body part 1 with appropriate knit-on parts 1A, LB separated from both legs 2, 3, but only for a better idea. After finishing the knitting of the knit-on part 1B the knit-on part 1A will be knitted in a similar way, while in this case there will be gradually connected the border lines H1A with the remaining border lines H2A, H3A of the knit-on parts 2A, 3A. The last operation will include knitting of the body part 1 by return movement of both of the needle rolls. When knitting the body part 1 similarly as in case of knit-on parts 1A, 1B are—for one direction of needle roll turning—put into operation the knitting needles e.g. of the lower needle roll, while during opposite movement of the needle rolls, there are put into operation the knitting needles of the upper needle roll. The knitting yard or yards are periodically switched over between the lower and the upper needle roll.

As it has already been stressed out, the knitted product according to the invention has—in consideration of the hitherto status of technics—many new characteristics and advantages. The most important ones include mainly the fact that the knitted product is free of any seams created by a sewing machine and it has a perfect anatomic shape. Due to the fact of being seamless, the knitted product does not cause deformations of buttocks and it is practically invisible under the outwear. It is perfectly flexible as it is made only of knitted fabrics and it is possible to suitably combine the initial materials of different characteristics. The manufacturing process produces negligible volumes of waste, the production is characterised by high degree of automation, it is economic—mainly in case of using a special double-roll small-diameter knitting machine.

INDUSTRIAL APPLICABILITY

The invention is designed for knitting of such products as panties, slips, trousers and mainly tights.

The invention claimed is:

1. A knitted panty hose garment, said garment comprising:
a knitted body;
a knitted first leg and a knitted second leg, said body and said legs defining therebetween a crotch portion;
said crotch portion including:
a pair of opposed knitted extra courses extending from at least one of 1/ said body 2/ said legs such that said pair of knitted extra courses are mutually knitted together for closing said crotch portion;
said pair of knitted extra courses includes:
a first knitted extra courses; and
a second knitted extra courses, said second knitted extra courses being a mirror image of said first knitted extra courses.

2. A knitted panty hose garment according to claim 1 wherein
said pair of knitted extra courses defines a first and second peak respectively, said first peak being disposed opposite to said second peak.

3. A knitted panty hose garment according to claim 1 wherein
each of said knitted extra courses is of triangular configuration.

4. A knitted panty hose garment, said garment comprising:
a knitted body;
a knitted first leg and a knitted second leg, said body and said legs defining therebetween a crotch portion;
said crotch portion including:
a pair of opposed knitted extra courses extending from at least one of 1/ said body 2/ said legs such that said pair of knitted extra courses are mutually knitted together for closing said crotch portion; and
each of said knitted extra courses includes:
a knitted border link which is knitted directly onto an adjacent knitted extra courses.

5. A knitted panty hose garment according to claim 1 including:
an additional knitted extra courses extending to the body.

6. A knitted panty hose garment according to claim 4 wherein
said knitted border link of at least one of said knitted extra courses of said body is linked to at least one of said knitted extra courses of said legs.

7. A knitted panty hose garment according to claim 4 wherein
at least one of said knitted extra courses of said body cooperates with an additional knitted extra courses extending to the body.

8. A knitted panty hose garment according to claim 1 wherein
said knitted extra courses are knitted from a different material to said material used for said body and said legs.

9. A knitted panty hose garment according to claim 1, wherein
said pair of knitted extra courses of said body and said pair of knitted extra courses of said legs close said crotch portion with said pairs extending in opposite directions.

10. A knitted panty hose garment according to claim 1 wherein
said body and legs and pairs of knitted extra courses are patterned.

11. A knitted panty hose garment according to claim 1, wherein
said legs are shaped as stockings with closed toes.

12. A method of making a knitted panty hose garment, said method comprising the steps of:
knitting a body;
knitting a first leg and knitting a second leg, said legs and said body defining therebetween a crotch portion;
knitting a pair of opposed knitted extra courses extending from at least one of 1/ said body 2/ said legs such that said pair of knitted extra courses are mutually knitted together for closing said crotch portion;
knitting the legs;
knitting the pair of knitted extra courses onto the respective legs;
knitting a pair of knitted extra courses of the body; and
knitting the body;
knitting the body and legs;
knitting the pair of knitted extra courses by a reciprocating motion using a double cylinder circular knitting machine.

13. A method of making a knitted panty hose garment, including a body, two legs and a crotch portion therebetween, said method comprising the steps of:
knitting said body;
knitting a pair of opposed knitted extra courses extending from at least one of 1/ said body 2/ said legs such that said pair of knitted extra courses are mutually knitted together for closing said crotch portion;
knitting said legs; and
wherein said legs, said body and the pair of extra courses are knitted by using a double cylinder circular knitting machine, said pair of extra courses being knitted by a reciprocating motion.

14. A method of making a knitted panty hose garment, including a body, two legs and a crotch portion therebetween, said method comprising the steps of:
knitting said legs;
knitting a pair of opposed knitted extra courses extending from at least one of 1/ said body 2/ said legs such that said pair of knitted extra courses are mutually knitted together for closing said crotch portion;
knitting said body; and wherein said legs, said body and the pair of extra courses are knitted by using a double cylinder circular knitting machine, said pair of extra courses being knitted by a reciprocating motion.

15. Method according to claim 13, including the step of:

knitting said pair of opposed knitted extra courses extending from said body and a further pair of opposed knitted extra courses extending from said legs.

16. Method according to claim 14, including the step of:

knitting said pair of opposed knitted extra courses extending from said body and a further pair of opposed knitted extra courses extending from said legs.

17. Method according to claim 14, including the steps of:

knitting the legs on said double needle cylinder circular knitting machine by a rotary motion of both needle cylinders of the circular knitting machine;

knitting said at least one pair of knitted extra courses by a reciprocating motion of both said needle cylinders of the circular knitting machine;

knitting said body portion with a reciprocating motion of said circular knitting machine.

18. Method according to claim 13, including the steps of:

knitting the body portion on said double needle cylinder circular knitting machine by a reciprocating motion;

knitting said at least one pair of knitted extra courses by a reciprocating motion of both said needle cylinders of the circular knitting machine;

knitting the legs on said double needle cylinder circular knitting machine by a rotary motion of both needle cylinders of the circular knitting machine.

19. A method according to claim 15 including the steps of:

knitting the legs on a double needle cylinder circular knitting machine by a rotary motion of both needle cylinders of the circular knitting machine;

knitting at least one of the pairs of knitted extra courses of the legs by a reciprocating motion of both of the needle cylinders of the circular knitting machine;

knitting at least one of the pairs of knitted extra courses of the body by a reciprocating motion of both of the needle cylinders of the circular knitting machine.

20. A method according to claim 15 including the steps of:

knitting the first and second legs on a double cylinder circular knitting machine by a rotary motion of a first and a second needle cylinder of the circular knitting machine;

knitting the pair of knitted extra courses of the legs by a reciprocating motion of both of the needle cylinders of the circular knitting machine as extensions of the respective legs;

knitting the pair of knitted extra courses of the body by a reciprocating motion of both of the needle cylinders of the circular knitting machine.

21. A method according to claim 15 including the step of gradually connecting edge lines of the pair of knitted extra courses of the body with corresponding edge lines of the pair of knitted extra courses of the legs.

* * * * *